US008308532B2

(12) United States Patent
Usui et al.

(10) Patent No.: US 8,308,532 B2
(45) Date of Patent: Nov. 13, 2012

(54) ABRASIVE ARTICLE

(75) Inventors: Akira Usui, Tokyo (JP); Yukio Yoshida, Tokyo (JP)

(73) Assignee: Kovax Corporation (JP)

( * ) Notice: Subject to any disclaimer, the term of this patent is extended or adjusted under 35 U.S.C. 154(b) by 294 days.

(21) Appl. No.: 12/686,913

(22) Filed: Jan. 13, 2010

(65) Prior Publication Data

US 2010/0112920 A1 May 6, 2010

Related U.S. Application Data

(63) Continuation of application No. PCT/JP2008/062600, filed on Jul. 11, 2008.

(30) Foreign Application Priority Data

Jul. 13, 2007 (JP) ..... 2007-184651

(51) Int. Cl.
*B24D 11/00* (2006.01)

(52) U.S. Cl. ..... 451/533; 451/538; 451/539; 451/523

(58) Field of Classification Search ..... 451/533–539, 451/523

See application file for complete search history.

(56) References Cited

U.S. PATENT DOCUMENTS 3,136,614 A * 6/1964 Kuzmick ..... 51/297
3,306,718 A * 2/1967 Chapin ..... 51/297
4,055,897 A * 11/1977 Brix ..... 433/166
4,606,154 A * 8/1986 Herrmann et al. ..... 451/533
4,988,554 A 1/1991 Peterson et al.
5,011,513 A 4/1991 Zador et al.
5,928,760 A * 7/1999 Usui et al. ..... 428/143
6,183,677 B1 * 2/2001 Usui et al. ..... 264/131
6,277,160 B1 8/2001 Stubbs et al.
6,419,573 B1 * 7/2002 Lise et al. ..... 451/533

(Continued)

FOREIGN PATENT DOCUMENTS

EP 0 414 346 A1 2/1991

(Continued)

OTHER PUBLICATIONS

The Extended European Search Report dated Jul. 29, 2010; Application No. / Patent No. 08791081.6-2302 / 2179818 PCT/JP2008062600.

(Continued)

*Primary Examiner* — George Nguyen
(74) *Attorney, Agent, or Firm* — Studebaker & Brackett PC; Donald R. Studebaker

(57) ABSTRACT

Provided is a durable abrasive article which can conform even to a surface of a complicated shape and has an excellent abrasive power and which does not give any deep flaw to become a problem at a subsequent step and is not broken even when used in sanding the surface of the complicated shape. The abrasive article comprises a flexible resin film, an abrasive grain layer formed on the surface of the resin film, and an extremely flexible resin layer formed on the abrasive grain layer, wherein the flexible resin film has a thickness of 10 to 200 μm, a tensile strength of 30 to 130 MPa and an elongation of 3 to 250%, wherein the abrasive grains of the abrasive grain layer are of P280 to P12, and wherein the extremely flexible resin layer has a 100% M of 1 to 20 MPa, a tensile strength of 20 to 90 MPa and an elongation of 250 to 1000%.

4 Claims, 5 Drawing Sheets

U.S. PATENT DOCUMENTS

| | | | | |
|---|---|---|---|---|
| 7,294,048 | B2 * | 11/2007 | Nelson et al. | 451/526 |
| 2002/0026752 | A1 * | 3/2002 | Culler et al. | 51/298 |
| 2004/0079033 | A1 | 4/2004 | Long | |
| 2005/0170765 | A1 * | 8/2005 | Shermer et al. | 451/538 |
| 2005/0235575 | A1 | 10/2005 | Long | |

FOREIGN PATENT DOCUMENTS

| | | | |
|---|---|---|---|
| EP | 0 771 613 | A1 | 5/1997 |
| JP | 1-81276 | | 5/1989 |
| JP | 03-043158 | | 2/1991 |
| JP | H03-79274 | A | 4/1991 |
| JP | 05-293765 | | 11/1993 |
| JP | 09-123065 | | 5/1997 |
| JP | 10-151572 | | 6/1998 |
| JP | H11-510745 | A | 9/1999 |
| JP | 2000-006035 | A | 1/2000 |
| JP | 2002-361565 | A | 12/2002 |
| JP | 3107068 | U | 11/2004 |
| JP | 2006-159343 | A | 6/2006 |
| TW | 310293 | | 7/1997 |
| TW | 400779 | U | 8/2000 |
| TW | I241939 | B | 10/2005 |

OTHER PUBLICATIONS

International Search Report; PCT/JP2008/062600; Aug. 19, 2008.

Japanese Office Action "Notice of Reasons for Rejection" with mailing date of Oct. 11, 2011; Japanese patent Application No. 2007-184651.

Office Action from Taiwan Intellectual Property Office with mailing date of Oct. 21, 2011; Taiwanese Patent Application No. 097126098.

* cited by examiner

ABRASIVE ARTICLE

TECHNICAL FIELD

The present invention relates to an abrasive article and, more particularly, to an abrasive article which is suited for use in the field of an automobile repairing industry or the like.

BACKGROUND ART

In the automobile repairing industry, an automobile is finished by repairing a portion damaged by an accident, or by replacing the damaged part by new one to such a level that the damaged portion cannot be discriminated from the original state.

The parts of the automobile portions to be repaired contain various ones such as bonnets, doors, roofs, front pillars, center pillars, rear fenders, back panels, trunk floors, bumpers, wheel houses, life baffles, battery trays, core supports and bumper beams.

These parts have not only flat portions but also portions of complicated shapes such as curved portions, pressed rough portions and holed portions. For example, the bonnets, the doors and the roofs have many flat portions, but the remaining parts have less flat portions but more complicated portions such as the curved portions, the pressed rough portions and the holed portions.

When the damaged portions having the recessed portions are to be repaired, these recessed portions are repaired by beating and applying putty. The repaired surfaces are coated with a primer surfacer, as called "prasurf" in the art, and then with an over-coating paint. When the damaged parts are replaced by new ones, the parts are also over-coated but may also be coated with the prasurf before the over-coating.

Prior to these coating steps, the surface to be coated is always roughened with abrasive paper or the like, so as to enhance the adhesion of the paint. This roughening treatment is called the "ashitsuke-sanding", which usually uses the abrasive paper or a nonwoven fabric abrasive. In the case of the roughing-sanding before the prasurf coating, for example, it is a current practice that the flat portions are sanded with the abrasive paper of P240 to P400 whereas the remaining portions such as the curved portions, the pressed rough portions and the holed portions are generally sanded with a nonwoven fabric abrasive equivalent to #320.

In the sanding, the abrasive paper is frequently preferred to the nonwoven fabric abrasive, because the abrasive paper is excellent in grinding property and short in working time.

However, the abrasive paper has poor conformability to the curved shape and a strong touch on the coated film. Thus, there arises a defect that a coated film separation is easily caused by an irregular sanding or an excessive sanding, when the curved portions, the pressed rough portions and the holed portions are sanded.

On the other hand, the nonwoven fabric abrasive is inferior in the grinding property and the working time to the abrasive paper, but has a suitable cushion and conforms easily to the shape of the object to be ground. Thus, the nonwoven fabric abrasive is frequently employed, when the complicated faces having the curved portions, the pressed rough portions and the holed portions are sanded.

However, the nonwoven fabric abrasive is inferior in a cutting power to a dry-sanding abrasive paper. Therefore, it is ordinary that the nonwoven fabric abrasive takes a long time for the sanding work and cannot keep the cutting power for a long time. Moreover, the nonwoven fabric abrasive has a low cutting power, and the user is required to work with all his or her strength. The user gets tired and finds it difficult to sand homogeneously and uniformly. Still moreover, the sanding with the nonwoven fabric abrasive has problems that it has a partially deep flaw easily and a sanding trace at a subsequent step.

Thus, the sanding with the nonwoven fabric abrasive has the various problems. For the complicated faces having the curved portions, the pressed rough portions and the holed portions, however, no abrasive article can have replaced the nonwoven fabric abrasive. Thus, it is the current practice that the nonwoven fabric abrasive has been continuously used for a long time.

Japanese Patent Laid-Open No. Hei. 9-123065 has disclosed an abrasive sheet which is used for adjusting the skin of a painted surface so that it is suited for repairing an automobile.

This abrasive sheet has an adhesive layer sandwiched between a flexible resin film and a flexible resin. Therefore, this abrasive sheet is so flexible that it can conform to and sand a very fine orange peel of several microns formed by painting.

However, this abrasive sheet was used to perform the roughing-sanding on a surface of a complicated shape to be repaired. The abrasive sheet could conform well to and sand the complicated surface to be repaired. However, it has been found that the abrasive sheet was so flexible that it caught and broke the complicated surface.

Patent Document 1: Japanese Patent Laid-Open No. Hei. 9-123065

DISCLOSURE OF THE INVENTION

Problems to be Solved by the Invention

An object of the invention is to provide an abrasive article, which can solve problems owned by either the nonwoven fabric abrasive of the prior art or the abrasive sheet disclosed in the aforementioned Patent Document. More specifically, the invention has an object to provide a durable abrasive article which can conform even to a surface of a complicated shape and has an excellent abrasive power and which does not give any deep flaw to become a problem at a subsequent step and is not broken even when used in sanding the surface of the complicated shape.

Means for Solving the Problem

An abrasive article according to the invention comprises a flexible resin film, an abrasive grain layer formed on the surface of the resin film, and an extremely flexible resin layer formed on the abrasive grain layer.

Moreover, the abrasive article of the invention is characterized in that the flexible resin film has a thickness of 10 to 200 μm, a tensile strength of 30 to 130 MPa and an elongation of 3 to 250%, in that the abrasive grains of the abrasive grain layer are of P280 to P12, and in that the extremely flexible resin layer has a 100% M of 1 to 20 MPa, a tensile strength of 20 to 90 MPa and an elongation of 250 to 1000%.

The resin film to be used in the abrasive article of the invention is not especially restricted in materials, if it functions as the backing member of the abrasive article. The resin film can be exemplified by a film of a polymer such as urethane resin or synthetic rubber NBR or SBR, although not especially limited thereto. Of the characteristics belonging to the resin film, the tensile strength and the elongation can be measured according to JIS P8113.

On the other hand, the abrasive grains to form the abrasive grain layer can be exemplified by the grains of an abrasive material such as aluminum oxide or silicon carbide. The abrasive grain layer can be formed by applying an epoxy resin or an urethane resin as a make-coat to the resin film and by applying abrasive grains to the make-coat.

Moreover, the extremely flexible resin layer is not especially restricted in materials, if it functions as a size-coat. The extremely flexible resin layer can be exemplified by a polymer such as an urethane resin or synthetic rubber NBR or SBR. In the invention, the phrase "extremely flexible" means that the extremely flexible resin layer has a still higher flexibility than that of the flexible resin film used in the invention. Moreover, the characteristics to be owned by the extremely flexible resin layer can be measured individually on the tensile strength and the elongation in accordance with the aforementioned JIS standards. The extremely flexible resin layer can be formed on the abrasive grain layer by the method which is usually employed in the art of the roll-coat or the like.

In an abrasive article of a preferred mode of the invention, an anti-clogging layer can be formed on the extremely flexible resin layer. Here, the "anti-clogging layer" means a layer having a function to prevent the so-called "clogging phenomenon", in which shavings formed in the sanding operation might otherwise enter the spaces in the abrasive thereby to obstruct the sanding. No special restriction is imposed on the material for the anti-clogging layer, if the material has that function. The anti-clogging layer can be exemplified mainly by metallic salt of an aliphatic group such as calcium stearate or zinc stearate. The anti-clogging layer can be formed on the extremely flexible resin layer by a method such as the roll-coat method which is usually employed in the art.

In an abrasive article of another preferred mode of the invention, a loop member can be formed on the back of the resin film. According to this mode, the abrasive article of the invention can be easily applied for use to a sponge pad or the like. Here, the "loop member" means the member which is disposed in a hook-and-loop fastener so as to retain the engaging force. The loop member may be formed on the back of the resin film by using an adhesive or a pressure-sensitive adhesive, which is usually employed in the art.

BEST MODE FOR CARRYING OUT THE INVENTION

With reference to the accompanying drawings, the present invention is described in more detail in connection with its embodiment.

FIG. 1 is a section showing an abrasive article 10 according to one embodiment of the invention in an enlarged scale.

With reference to FIG. 1, an abrasive article 10 according to the invention is produced by forming an extremely thin adhesive layer 12 as a make coat on the surface of a flexible resin film 11, by adhering abrasive grains 13 to the adhesive layer 12 thereby to form a grain layer, and by applying an extremely flexible resin layer 14 as a size coat to the grain layer.

In this embodiment, an anti-clogging layer 15 is formed on the extremely flexible resin layer 14. In the embodiment, moreover, an adhesive layer 16 is formed on the back of the resin film 11, thereby to adhere a loop member 17.

In the abrasive article 10 of the invention, the resin film 11 has a thickness of 10 to 200 μm, preferably 30 to 80 μm. Moreover, the resin film 11 has a tensile strength of 30 to 130 MPa, preferably 40 to 80 MPa, and an elongation of 3 to 250%, preferably 3 to 100%.

Thus, the abrasive article 10 of the invention adopts the resin film 11 having the high tensile strength but the small elongation. As a result, the abrasive article 10 is so enhanced in strength as to conform to a far more complicated shape than that of the rough orange peel of micron units, at which the invention of the aforementioned Japanese Patent Laid-Open No. Hei. 9-123065 aimed, and to have a high abrasive power but not to be easily broken.

The abrasive grains 13 of the grain layer are of P280 to P12, preferably P280 to P120. The extremely flexible resin layer 14 has a 100% M of 1 to 20 MPa, preferably 1.5 to 3 MPa. The tensile strength is 20 to 90 MPa, preferably 35 to 55 MPa. The elongation is 250 to 1000%, preferably 600 to 800%.

FIG. 2 is a perspective view showing the using mode, in which the abrasive article 10 is adhered as one embodiment of the invention to a sponge pad 20.

In this embodiment, as described above, the loop member 17 is adhered through the adhesive layer 16 to the back of the resin film 11 of the abrasive article 10, so that the abrasive article 10 can be easily used by applying the same to the sponge pad 20. When the complicated face of an automobile is to be sanded, moreover, a hook member 21 to engage properly with the loop member 17 disposed on the abrasive article 10 is adhered to the surface of the sponge pad 20, so that the abrasive article 10 can be applied, when used, to the sponge pad 20.

EXAMPLE

The invention will be described in more detail in connection with the following example, but should not be limited thereto.

(1) Preparations of Specimens

The abrasive article of the embodiment of the invention and specimens of Comparative Examples 1 to 3 were individually prepared in the following manners:

Example

An epoxy resin was applied as the make-coat to a resin film having a thickness of 50 μm, a tensile strength of 49 MPa and an elongation of 5%, and aluminum oxide abrasive grains of P180 were adhered to the epoxy resin by an electrostatic deposition method and were dried. Next, a resin having a 100% M of 2.2 MPa, a tensile strength of 44.1 MPa and an elongation of 700% was applied as the size-coat to those abrasive grains by a roll-coat method, and was dried and solidified. Moreover, that resin was roll-coated with calcium stearate containing a cellulose-family binder as an anti-clogging material, and was dried and solidified so that the abrasive article was produced.

The adhesive layer was formed on the back (opposite to the side, on which the grain layer had been formed) of the aforementioned resin film, and the loop member was formed on the adhesive layer.

Then, the abrasive article having the loop member formed thereon was cut to a suitable size. At the same time, a sponge pad having a hook member adhered to the surface thereof was prepared, and the cut abrasive article was applied to the sponge pad.

Comparative Example 1

There was prepared a nonwoven fabric abrasive Scotch Bright 7447 (Product of 3M Corporation) corresponding to #320.

Comparative Example 2

There was prepared an abrasive paper SFACM (Product of Kovax Corporation) of P320. Here, the loop member was formed on the back of the dry-sanding abrasive paper by the same method as that of Example, and the sanding was performed by applying the abrasive paper to the sponge pad having the hook member adhered thereto.

Comparative Example 3

An abrasive sheet of P500 was prepared according to the invention, as set forth in Japanese Patent Laid-Open No. Hei. 9-123065. The sanding operation was performed by applying the abrasive sheet to the sponge pad (Buflepad AS).

(2) Evaluations of Specimens

The performances of those specimens were evaluated on the following items.

(2-1) Abrasiveness

A painted surface (of RETAN PG-80, Black, Product of Kansai Paint Co., Ltd.) of a flat shape having a size of 200×200 mm was prepared as the object to be sanded. By using the specimens of Example and Comparative Examples 1 and 2, the painted surfaces were manually sanded all over by the dry-sanding method, and the sanding time periods were recorded.

The evaluation results are tabulated in Table 1.

TABLE 1

| | Specimen | | |
|---|---|---|---|
| | Example 1 | Comparative Example 1 | Comparative Example 2 |
| Sanding Time (seconds) | 14 | 54 | 26 |

From the results tabulated in Table 1, it is understood that the abrasive article of the invention has more excellent cutting properties than those of the nonwoven fabric abrasive of Comparative Example 1 and the ordinary abrasive paper of Comparative Example 2.

Moreover, the magnitude of a force needed at a sanding time was, although its numerical evaluation is difficult, the smallest for the abrasive article of the invention, and was sequentially followed by the abrasive paper of Comparative Example 2 and the nonwoven fabric abrasive of Comparative Example 1. Especially, the sanding by the nonwoven fabric abrasive of Comparative Example 1 required a considerable force, and the sanding method adopted herein was manual so that it was rather hard on the worker.

(2-2) Surface Roughness

The roughness of the aforementioned coated surface, which had been sanded by means of the specimens of Example and Comparative Examples 1 and 2, was measured by using the tracer-type surface roughness meter (Handy Surf E-35A produced by Tokyo Seimitsu Co., Ltd.). The primary profiles of the coated surfaces obtained by the measurements are tabulated in FIGS. 3(A) to 3(C). Moreover, the surface roughnesses Rmax and Rz, which were calculated from those primary profiles, are tabulated in Table 2 together with the surface roughnesses Ra and Rt obtained from roughness profiles.

TABLE 2

| | Specimen | | |
|---|---|---|---|
| Surface roughness (μm) | Example 1 | Comparative Example 1 | Comparative Example 2 |
| Ra | 0.69 | 0.61 | 0.63 |
| Rmax | 6.83 | 7.75 | 5.73 |
| Rz | 5.58 | 5.90 | 5.06 |
| Rt | 6.54 | 7.26 | 5.41 |

In Table,
Ra: Arithmetical mean deviation,
Rmax: Maximum height,
Rz: Ten-point height of irregularities, and
Rt: Maximum height.

From FIG. 3 and Table 2, it is understood that the damages of the abrasive article of the invention and the ordinary abrasive paper of Comparative Example 2 were relatively averaged and not especially deep, although the faces sanded by the nonwoven fabric abrasive of Comparative Example 1 had many scratches partially and were not homogeneous in flaw depth.

Thus, it is understood that the scratches, which are discovered at a later step and will raise problems when the nonwoven fabric abrasive is used, are reduced in the abrasive article of the invention.

(2-3) Conformability

A bonnet was prepared as an object to be sanded, and the pressed rough portions and the holed portions of the back were manually sanded all over the surface of the coated film by the dry-sanding method using the specimens of Example and Comparative Examples 1 to 3. The states of the sanded surfaces of the bonnet were visually observed to evaluate the surfaces having no irregularity and no unsanded portion as ◎, the surfaces having irregularity but no unsanded portion as ○, the surfaces sanded excessively to expose the backing as Δ, and the surfaces partially unsanded as X.

(2-4) Product Strength

After the conformability had been confirmed, the specimens were observed to evaluate damages such as tears.

The evaluation results of the conformability and the product strength are tabulated in Table 3:

TABLE 3

| | Specimen | | | |
|---|---|---|---|---|
| | Example | Comparative Example 1 | Comparative Example 2 | Comparative Example 3 |
| Curved Portion | ◎ | ○ | Δ | ◎ |
| Recessed Portion | ◎ | ○ | X | ◎ |
| Raised Portion | ◎ | ○ | Δ | ◎ |
| Holed Portion | ◎ | ○ | Δ | ◎ |
| Broken | No | No | No | Yes |

From Table 3, it is understood that the abrasive article of the invention can conform well to the surface of complicated shape and can sand even the complicated surface without breaking the same.

Thus, the abrasive article of the invention can conform well to the shape of the complicated surface. This is because the backing member employed is flexible and because the size-coat resin employed is extremely flexible.

Moreover, the abrasive article of the invention is strong against the complicated surface. This is because the flexible backing member is enhanced in strength. This effect of the invention is made more prominent by forming the loop member on the abrasive article and by mounting the abrasive article on the sponge pad.

Still moreover, the abrasive article of the invention is more excellent in abrasiveness than not only the nonwoven fabric abrasive but also the ordinary abrasive paper. This is because the size-coat is exemplified by the extremely flexible resin so that the coarse abrasive can be used to reduce the sanding inhibition which might otherwise be caused by chips.

Industrial Applicability

The abrasive article of the invention has the features of abrasive paper excellent in abrasiveness and can conform well to a complicated shape so that it is properly used as a novel sanding tool in place of the nonwoven fabric abrasive which has been conventionally used for sanding the surface of a complicated shape in the automobile repairing industry.

Moreover, the abrasive article of the invention can save the trouble and time of labor drastically and can improve the finished state remarkably, when it is used in place of the nonwoven fabric abrasive of the prior art.

DESIGNATIONS OF REFERENCE NUMERALS

Figure 1:
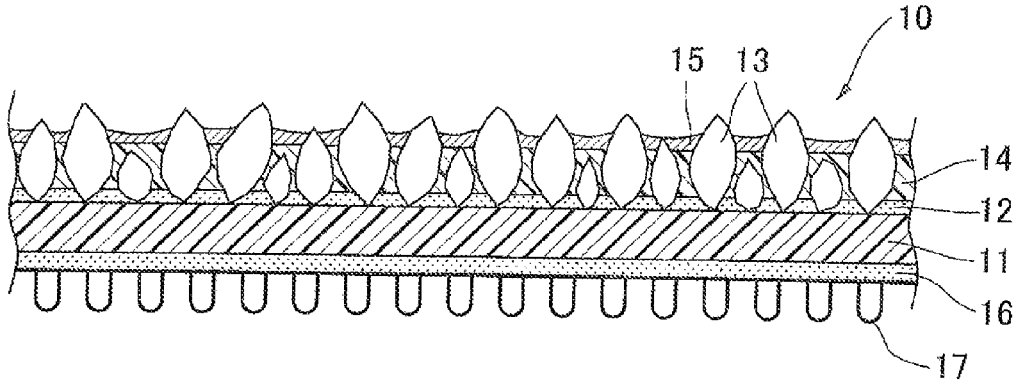
FIG. 1 An enlarged section of an abrasive article according to one embodiment of the invention.
Figure 2:
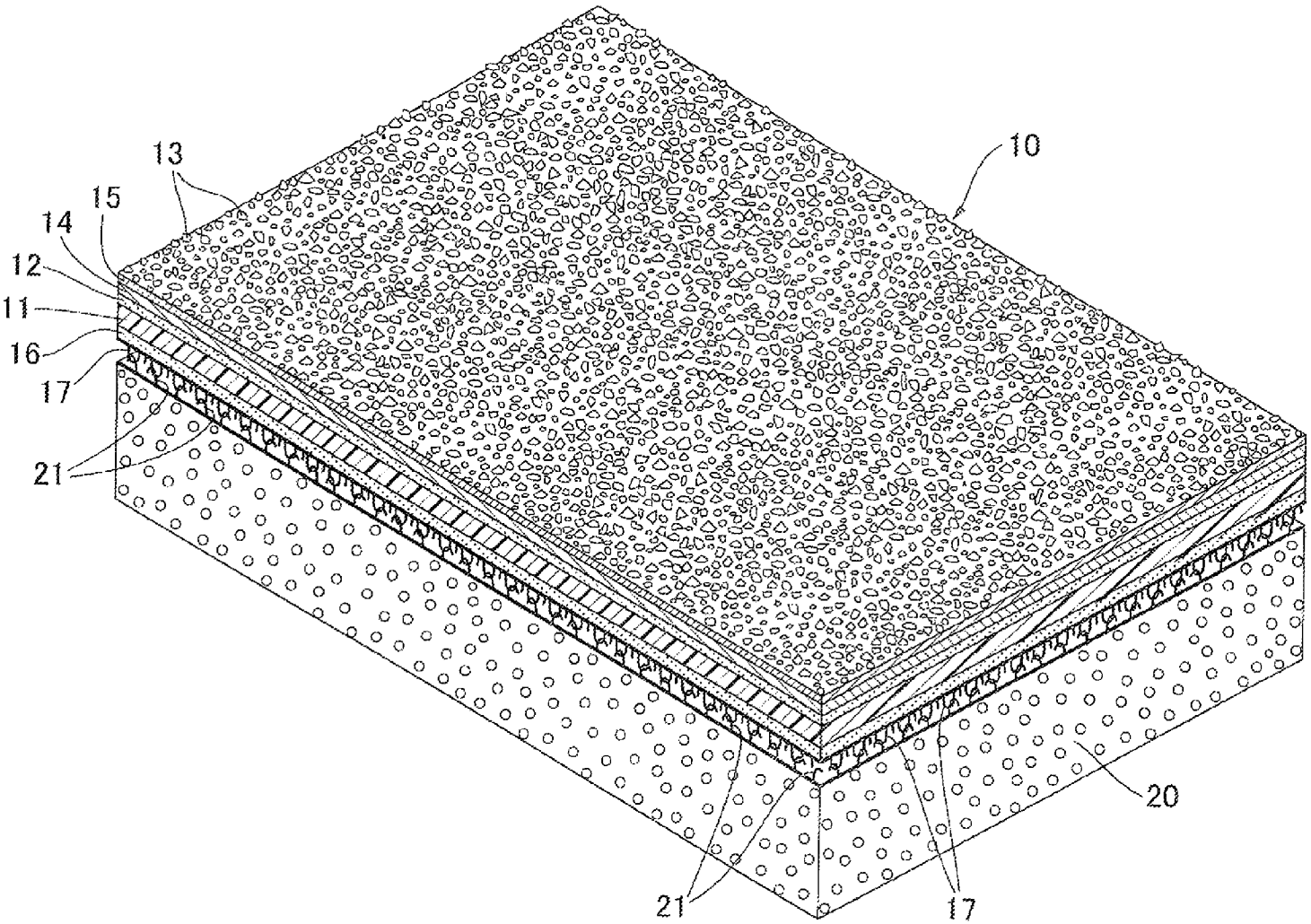
FIG. 2 A perspective view showing the using mode of the abrasive article of one embodiment of the invention.
Figure 3A:
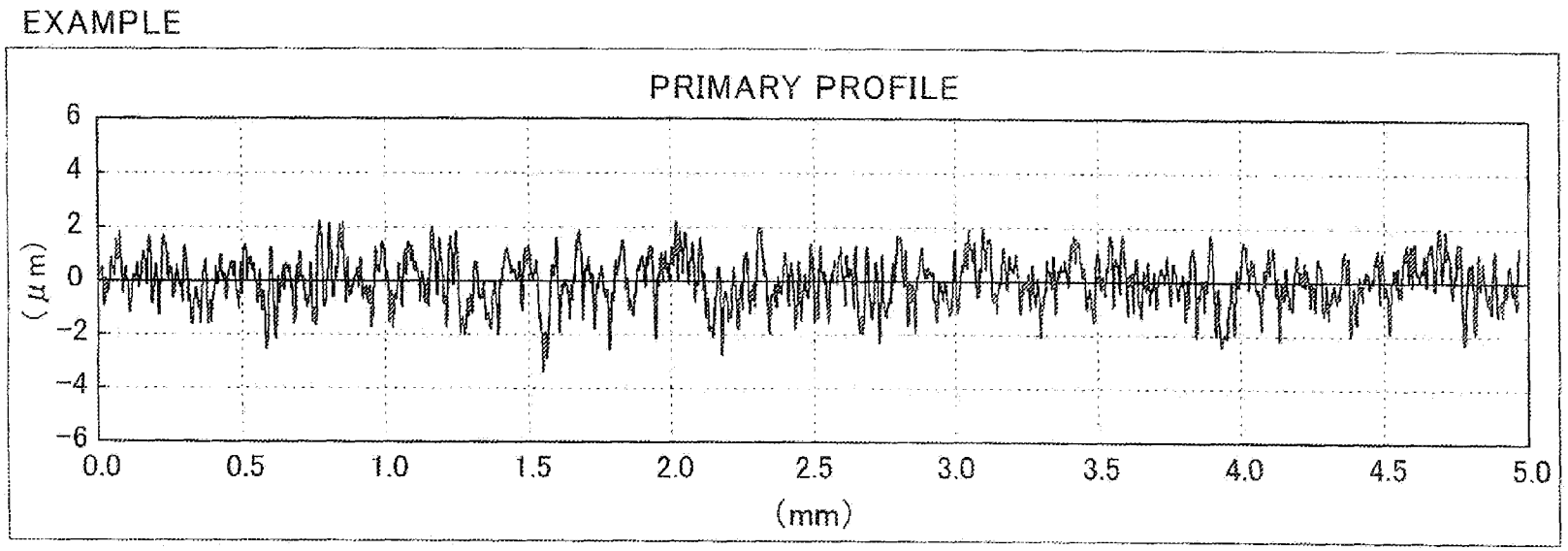
FIG. 3(A) A graph of a surface roughness of Example.
Figure 3B:
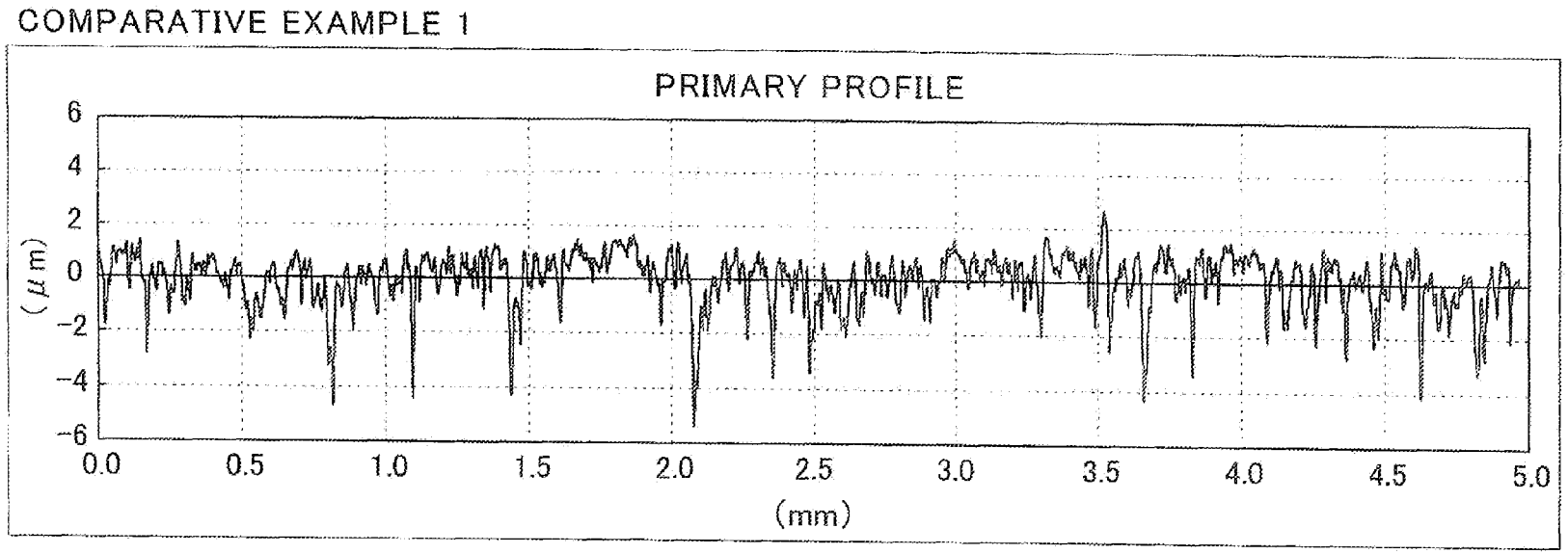
FIG. 3(B) A graph of a surface roughness of Comparative Example 1.
Figure 3C:
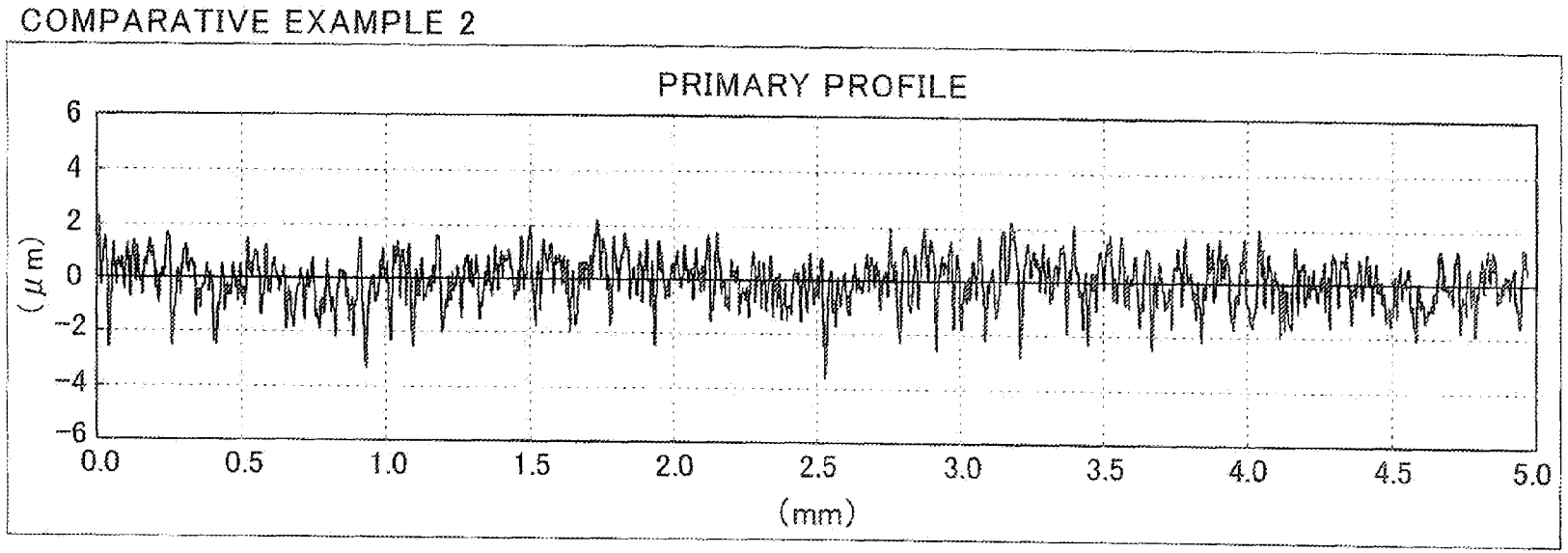
FIG. 3(C) A graph of a surface roughness of Comparative Example 2.

10 Abrasive Article
11 Resin Film
13 Abrasive Grains
14 Extremely Flexible Resin Layer
15 Anti-Clogging Layer
16 Adhesive Layer
17 Loop Member

The invention claimed is:

1. An abrasive article comprising a flexible resin film, an abrasive grain layer formed on the surface of the resin film, and an extremely flexible resin layer formed on the abrasive grain layer, characterized in that:

said resin film has a thickness of 10 to 200 μm, a tensile strength of 30 to 130 MPa and an elongation of 3 to 100%;

said abrasive grains of said abrasive grain layer are of P280 to P12; and said extremely flexible resin layer has a 100% M of 1 to 20 MPa, a tensile strength of 20 to 90 MPa and an elongation of 250 to 1000%.

2. The abrasive article as set forth in claim 1, wherein an anti-clogging layer is formed on said extremely flexible resin layer.

3. The abrasive article as set forth in claim 1, wherein a loop member is formed on the back of said resin film.

4. The abrasive article as set forth in claim 2, wherein a loop member is formed on the back of said resin film.

* * * * *